United States Patent [19]

Kelley et al.

[11] Patent Number: 4,976,502

[45] Date of Patent: Dec. 11, 1990

[54] CABINET WITH POCKETING DOORS

[75] Inventors: James O. Kelley, Spring Lake; George A. Williams, Hudsonville; Andrew J. Kurrasch, Saugatuck, all of Mich.; Geoffrey A. Hollington, London, England

[73] Assignee: Herman Miller, Inc., Zeeland, Mich.

[21] Appl. No.: 342,957

[22] Filed: Apr. 25, 1989

[51] Int. Cl.[5] ..... A47B 88/00

[52] U.S. Cl. ..... 312/322; 312/331

[58] Field of Search ..... 312/331, 110, 322

[56] References Cited

U.S. PATENT DOCUMENTS

| | | | |
|---|---|---|---|
| 2,667,400 | 1/1954 | Wotring . | |
| 2,669,499 | 2/1954 | Vanderplank . | |
| 2,936,206 | 5/1960 | Wilmer et al. . | |
| 3,456,995 | 7/1969 | Nyquist . | |
| 3,794,401 | 2/1974 | Dean et al. | 312/331 |
| 4,641,896 | 2/1987 | Iimura et al. . | |
| 4,729,612 | 3/1988 | Stone . | |
| 4,821,375 | 4/1989 | Kozon | 312/331 |

*Primary Examiner*—Kenneth J. Dorner
*Assistant Examiner*—Gerald A. Anderson
*Attorney, Agent, or Firm*—Varnum, Riddering, Schmidt & Howlett

[57] ABSTRACT

A cabinet having a door moveable between a closed position, an open and partially pocketed position, and an open and fully pocketed position. The cabinet further comprises means for aligning the door relative to the cabinet side wall prior to moving the door into the cabinet.

36 Claims, 10 Drawing Sheets

CABINET WITH POCKETING DOORS

BACKGROUND OF THE INVENTION

1. Field of the Invention

The invention relates to cabinets and in particular cabinets having assemblies for mounting doors of the cabinets in such a manner that the doors can be swung opened and subsequently moved rearwardly or pocketed into the cabinet proper.

2. Description of the Prior Art

Generally, cabinets for use in office and other environments have doors for closing off open fronts of the cabinets. Typically, a door is hinged at one of its sides adjacent a side wall of the cabinet, swings toward a worker opening it and can be subsequently pushed sideways to secure work space in front of the cabinet pursuant to movement of articles in and out of the same. However, in such position, the door may interfere with other work being performed in the work environment. In addition, in crowded work environments, the extent to which the door can be opened may be limited thus restricting work space in front of the cabinet.

To eliminate the above-identified problems associated with cabinets having conventional hinged doors, some of today's cabinets are designed with pocketing assemblies permitting rearward movement of the open-out doors into the cabinets adjacent side walls of the same. In this stored or pocketed position of the doors, the same are in positions out of interference with work being performed in and around the cabinets. Cabinets with pocketing doors are disclosed in Stone U.S. Pat. No. 4,729,612, issued Mar. 8, 1988; Wilmer et al. U.S. Pat. No. 2,936,206, issued May 10, 1960; Iimura et al. U.S. Pat. No. 4,641,896, issued Feb. 10, 1987; and Nyquist U.S. Pat. No. 3,456,995, issued July 22, 1969.

For example, Wilmer et al. disclose a cabinet with pocketing doors and comprising a vertical carrier hingeably connecting a door and slidably mounted to upper and lower rails mounted to the cabinet side wall. After the door has been placed in the open position, it can be moved rearwardly with the carrier into the cabinet.

Nyquist also discloses a cabinet having pocketing doors, wherein a scissor mechanism is mounted to and between the cabinet back wall and a rear edge of the door. A rod at the rear edge of the door is rotatably and slidably received in opposing channels within top and bottom walls of the cabinet to permit the door to pivot in opening and closing, and to guide the door when the same is moved in and out of the cabinet.

A common problem associated with cabinets having pocketing doors is that the doors have a tendency to tilt or rotate in a vertical plane. As a result, difficulty is experienced when opening and closing the door, and when pocketing and unpocketing the door and the door and the fittings therefor can be damaged.

To remedy this problem, it has been found desirable to provide a means for stabilizing pocketing doors to prevent rotation of the same in vertical planes. Such stabilizing means are known. For example, the U.S. patent to Stone, identified above, discloses a pocketing door pivotally and slidably mounted to upper and lower tracks by slide members secured to the doors, the tracks being mounted to the cabinet side wall. A pair of pulleys are mounted below the rear portion of the upper track and above the front portion of the lower track. A cable is threaded around the pulleys and has first and second ends attached to the slide members. The arrangement is said to prevent relative movement between the upper and lower slide members to prevent the door from jamming when moved in and out of the cabinet.

The U.S. patent to Iimura et al. also provides a stabilizing means for a pocketing door. A pair of rotatable pinions are mounted on upper and lower corners of the door and engage racks on the cabinet side wall to enable the door to be pocketed within the cabinet without jamming. The rack and pinion mechanism assures that the upper and lower corners of the door are inserted or withdrawn from the rack at the same rate.

Further, Wilmer et al. disclose a cabinet having pocketing doors and means for preventing undesired movement of the door. Specifically, the upper and lower rails have flanges extending along the full length of the rails. For each flange, a pair of upper and lower brackets are mounted on the carrier in spaced relationship thereby forming a slot receiving the respective rail flange. In this manner, when the carrier is moved along the rails, the pairs of brackets embrace the rail flanges to prevent excessive rocking movement of the carrier and thus the door mounted thereto.

For those cabinets with door pocketing assemblies wherein tracks or rails are used to guide the doors into the cabinets, Applicant has found it desirable to provide a means for aligning the open-out doors with the tracks for subsequent insertion into the cabinets.

It has also been found desirable to provide a pocketing door with a handle rotatably mounted to the door so that a user can grasp the handle to open the door and pocket the same while maintaining the orientation of the handle toward himself/herself for convenient and easy operation of the door.

SUMMARY OF THE INVENTION

An assembly for mounting a door on a cabinet, wherein the cabinet comprises a side wall, an open front and an interior, and wherein the assembly comprises first and second mounting means. The first mounting means is adapted to pivotally mount the door on the cabinet for movement between a closed position in which the door covers the open front of the cabinet and an open position permitting access to the interior of the cabinet. The second mounting means for the assembly is adapted to slidably mount the door on the cabinet for movement between the open position and a pocketed position within the interior of the cabinet at a predetermined angle relative to the cabinet side wall. The improvement comprises a guide means cooperable between the door and the cabinet and adapted to align the door with the direction of movement of the door between the open and pocketed positions when the door is moved to the open position.

DESCRIPTION OF THE PREFERRED EMBODIMENT

Figure 1:
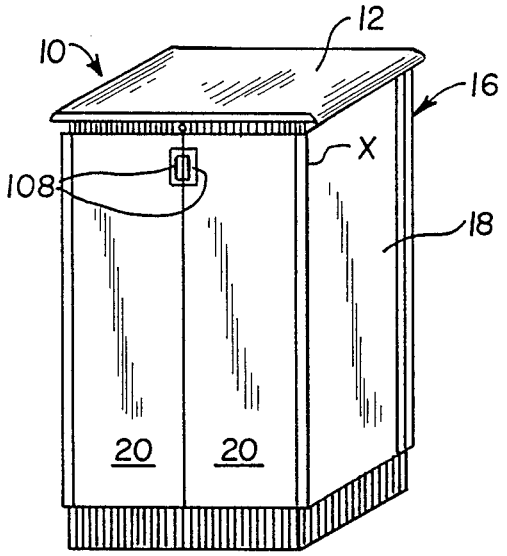
FIG. 1 is a perspective view of a cabinet of the type which may employ pocketing doors and door handles according to the invention.
Figure 2:
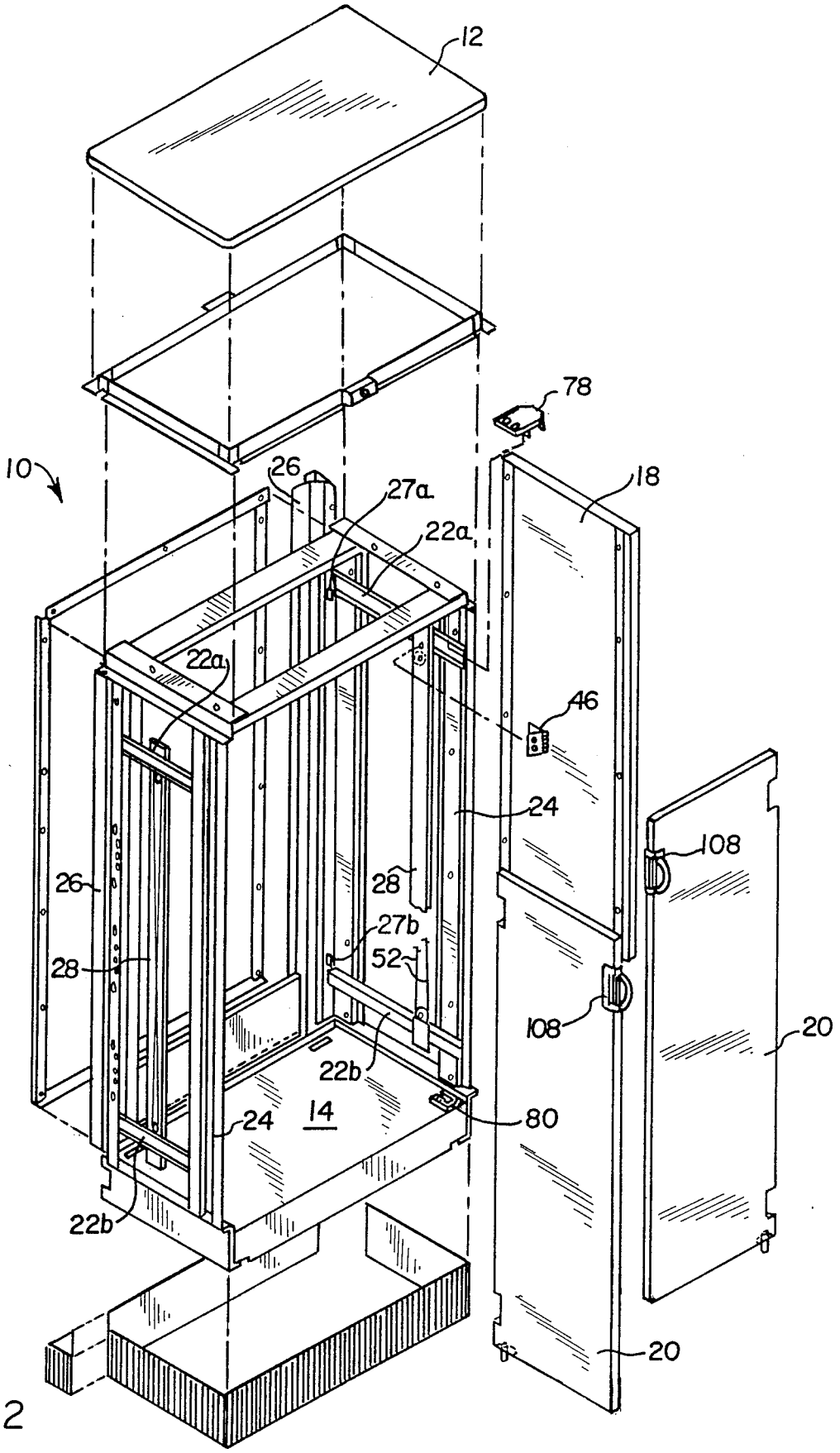
FIG. 2 is an exploded perspective view of framing of the type which may be used in a cabinet according to FIG. 1.

Referring to the drawings, and more particularly to FIGS. 1 and 2, the invention is shown in conjunction with a cabinet 10, having a top wall 12, a bottom wall 14, a back wall 16, a pair of side walls 18, and a pair of pocketing doors 20, it being understood that the cabinet forms no part of the invention in its broader aspects. Shown specifically in FIG. 2 is a typical framework for a cabinet of the type shown in FIG. 1, it being understood that numerous variations may be made in the design of the framework without affecting the function and operation of the invention.

Figure 3:
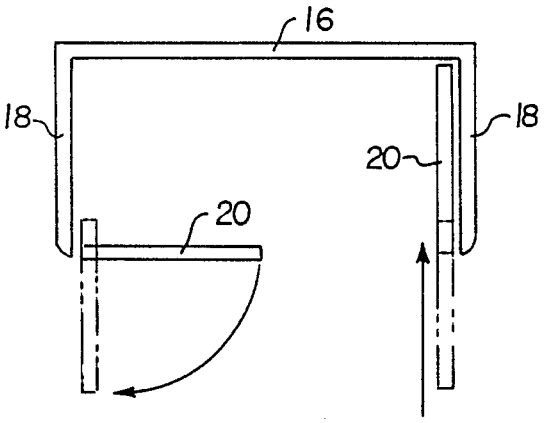
FIG. 3 is a plan view showing schematically the operation of the pocketing doors according to the invention and in conjunction with the cabinet of FIGS. 1 and 2.

Referring to FIG. 3, the cabinet incorporates the "pocketing" doors 20. That is, the doors 20, after being swung open, can be moved rearwardly to be stored within the cabinet adjacent the side walls 18 thereof. The arrows of FIG. 3 describe the direction of movement of the doors 20. Thus, the doors 20 may be moved between a closed position, as shown by the solid line representation for the left-hand door of FIG. 3, an open and partially pocketed position, as shown by the interrupted line representations for the left- and right-hand doors of FIG. 3, and an open and fully pocketed position, as shown by the solid line representation for the right-hand door of FIG. 3. The pocketing feature facilitates access to the cabinet while avoiding the hindrance of having to open and close the doors each time access to the cabinet is desired. In addition, the pocketing feature permits positioning of the doors out of interference with activities being performed in and around the cabinet. This is particularly helpful where the office environment provides limited space for admittance into the cabinet.

To accommodate the pocketing door feature of the cabinet, the same is provided with a pocketing assembly hingeably and slidably connecting the doors to the cabinet proper. The assembly generally comprises mounting means for hingeably and slidably mounting the doors relative to the cabinet so that subsequent to opening the doors the same can be moved rearwardly into the cabinet. The assembly also comprises stabilizing means for resisting rotation of the doors in a vertical plane to ensure smooth operation of the doors without jamming. The assembly further comprises means for partially pocketing the door within the cabinet when it is moved from the closed position to the open position. The assembly additionally comprises means for aligning the door relative to the cabinet side wall upon movement from the closed position to the open and partially pocketed position so the doors can be easily and smoothly moved rearwardly into the cabinet.

Figure 5:
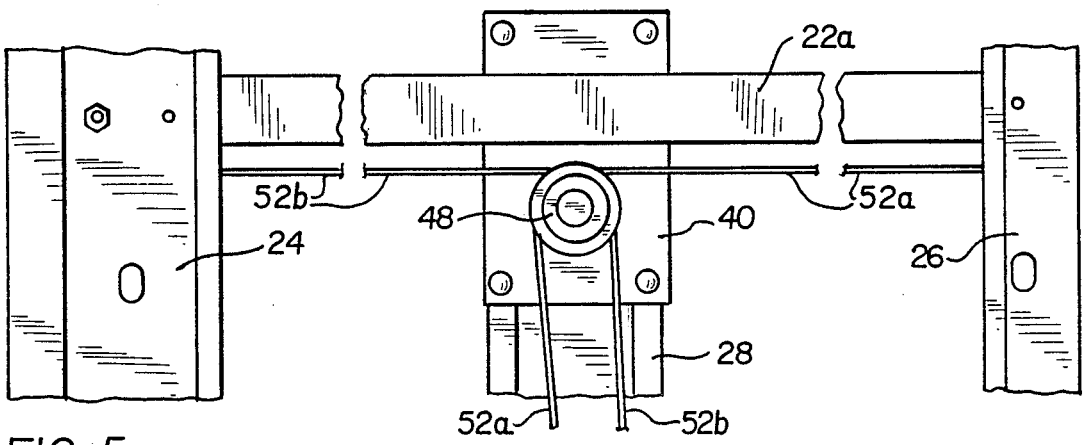
FIG. 5 is an enlarged elevational view of the area of interest designated by the reference numeral A in FIG. 4.
Figure 6:
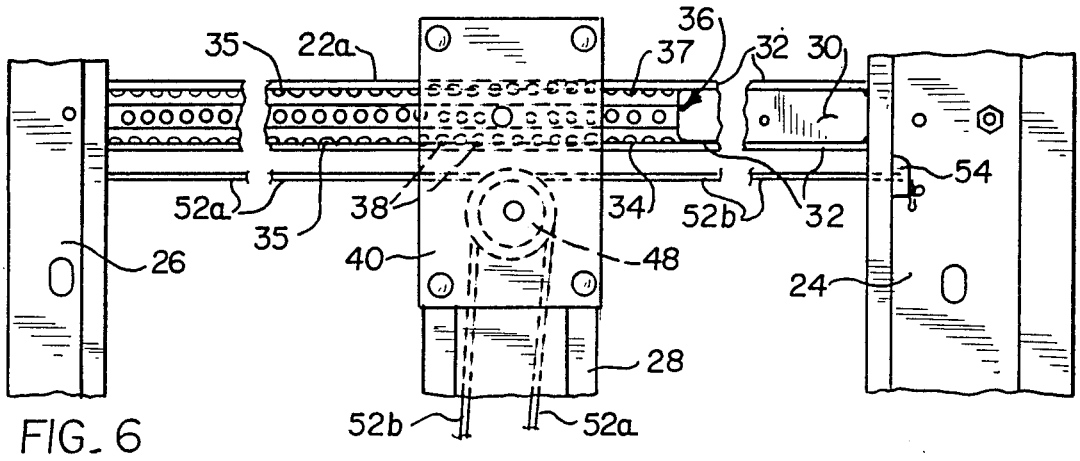
FIG. 6 is an enlarged elevational view similar to FIG. 5 but looking from a position interior of the cabinet and showing a vertical carrier bar and a ball cage according to the invention.
Figure 4:
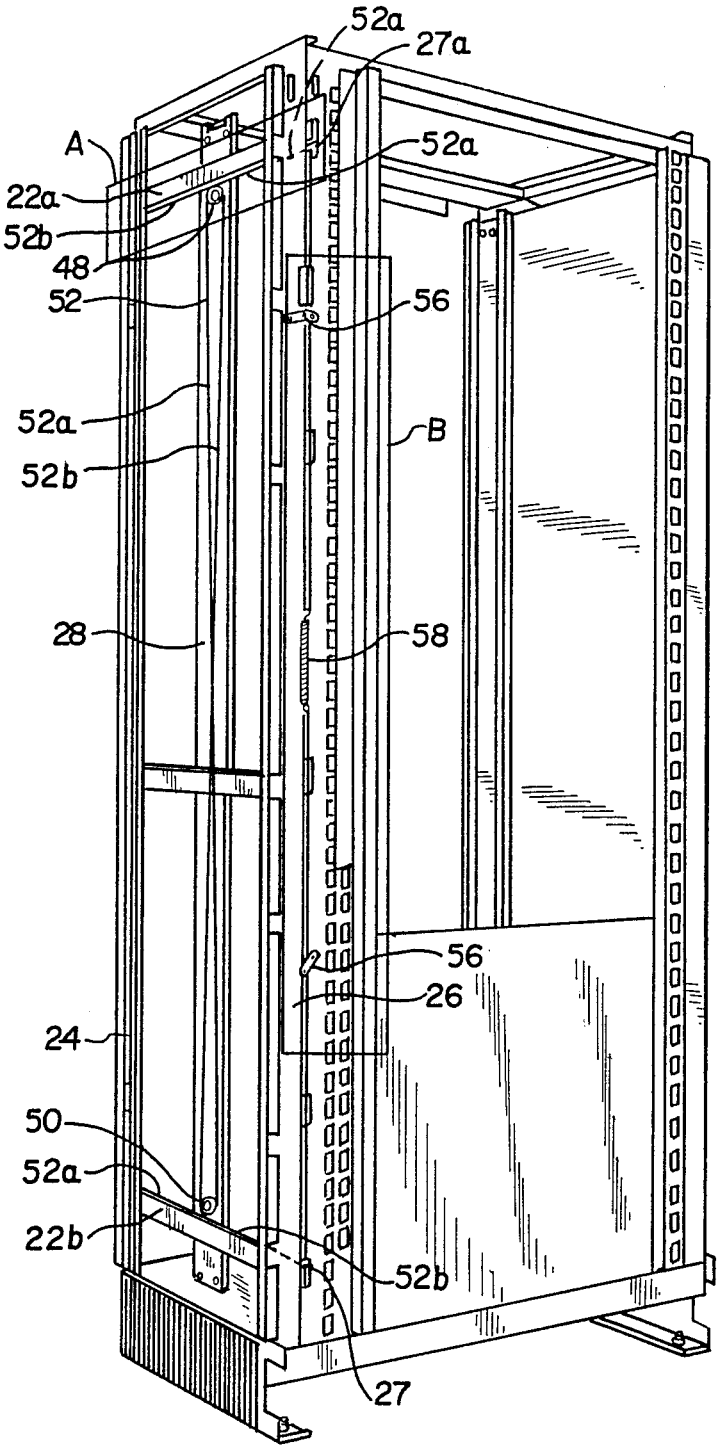
FIG. 4 is a perspective view of a partially assembled frame for the cabinet of FIGS. 1–3 looking from a position exterior to the cabinet and showing the arrangement of the cable for the pocketing doors.
Figure 5A:
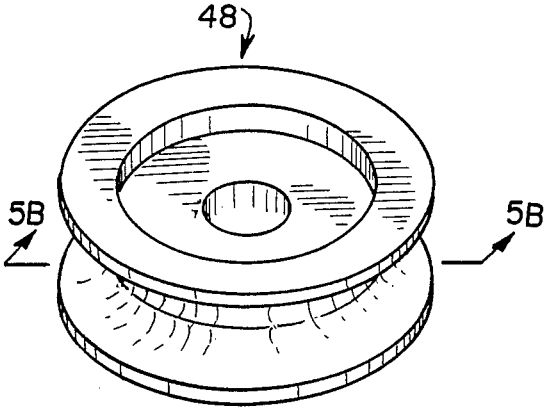
FIG. 5A is a perspective view of a two track pulley according to the invention.
Figure 5B:
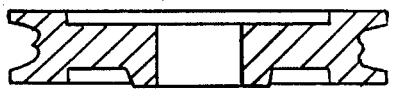
FIG. 5B is a sectional view of the two track pulley of FIG. 5A along lines 5B—5B.

As illustrated in FIGS. 4–6, the means for slidably mounting the doors to the cabinet comprises, on each side of the same, a pair of upper and lower horizontal guide frames 22a, 22b securely mounted to and between the cabinet front and rear vertical frame members 24, 26 at upper and lower ends and inside surfaces thereof. Holes 27a, 27b in the rear vertical frame members 26 function to receive rear ends of the guide frames 22a, 22b for mounting purposes. The mounting means further includes a vertical carrier bar 28 slidably mounted to the upper and lower guide frames 22a, 22b for movement between front and rear ends of the guide frames.

The guide frames 22a, 22b each comprise generally an elongated rectangular channel-like member 30 formed with flanges 32 at upper and lower edges thereof. Slidably received for horizontal movement within the channel of each guide frame 22a, 22b between the upper and lower flanges is a ball slide 36. The ball slide 36 is a channel-like member formed with flanges 35 at upper and lower edges thereof. The flanges 35 are slightly contoured to create upper and lower tracks or races 34. Slidably received within the channel of the ball slide 36 is a ball cage 37. A plurality of ball bearings 38 associated with the ball cage 37 rest within the upper and lower races or tracks 34 for carrying the ball cage 37 back and forth between front and rear ends of the guide frame. An example of a satisfactory ball cage is manufactured by Accuride Inc., Santa Fe Springs, Calif. under the name Two Member Ball Bearing Slide. A slide plate 40 is secured to the ball cage 37 for sliding movement relative to the ball slide 36 and the guide frames 22a, 22b. The carrier bar 28 is securely mounted, as by spot welding, to the slide plate 40.

Figure 9A:
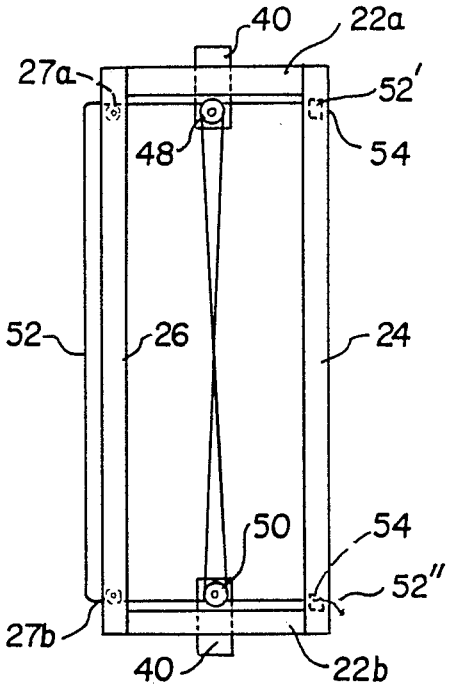
FIG. 9A is a schematic view of the arrangement of the cable alternative embodiment of FIG. 9.
Figure 10A:
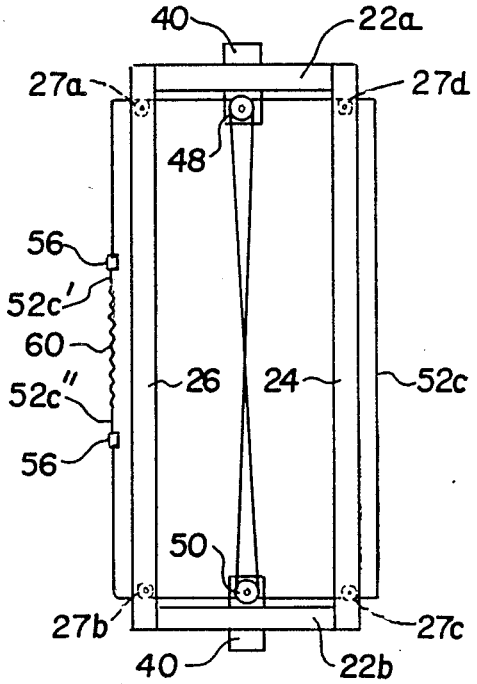
FIG. 10A is a schematic view of the arrangement of the cable of the further embodiment of FIG. 10.
Figure 9:
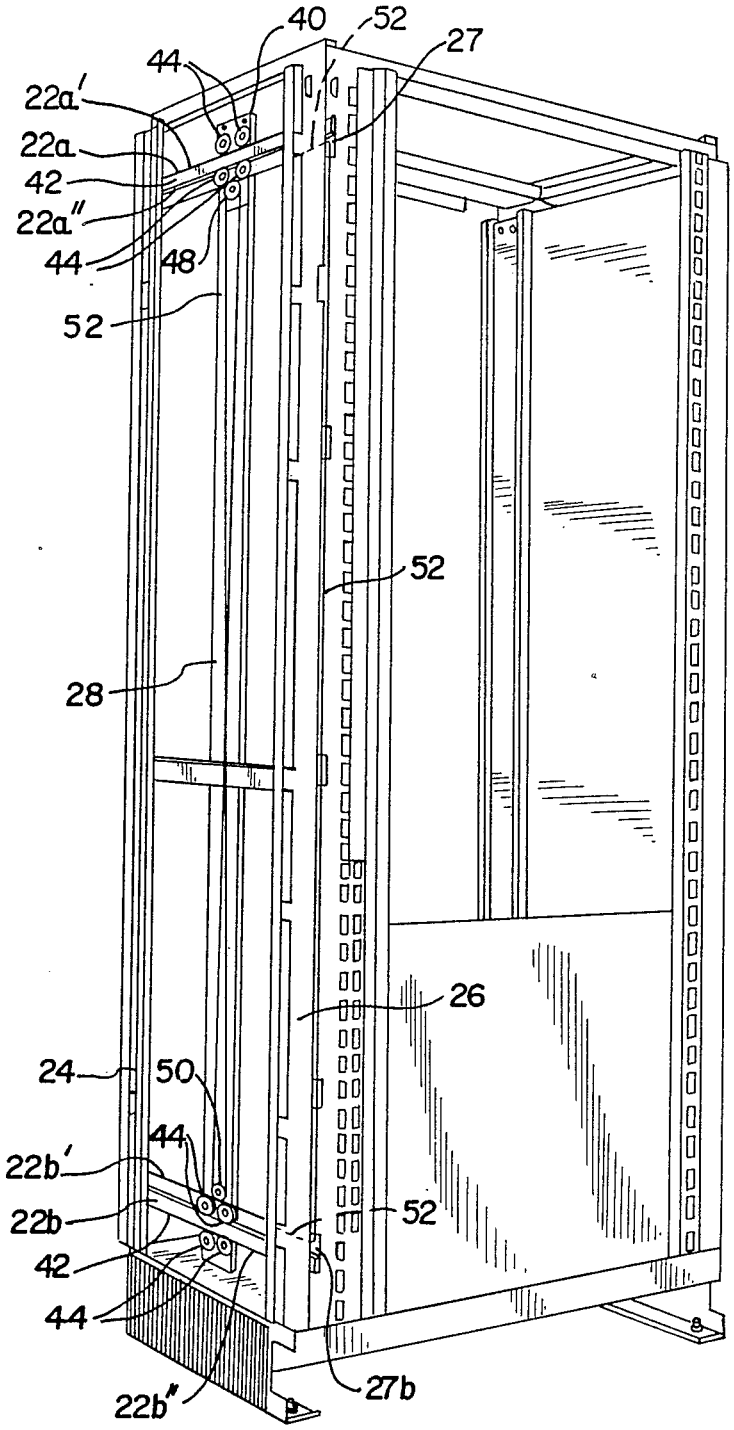
FIG. 9 is a perspective view similar to FIG. 4 but showing an alternative embodiment for the arrangement of the cable for the pocketing doors and showing alternative means for slidably mounting the doors to be cabinet.
Figure 10:
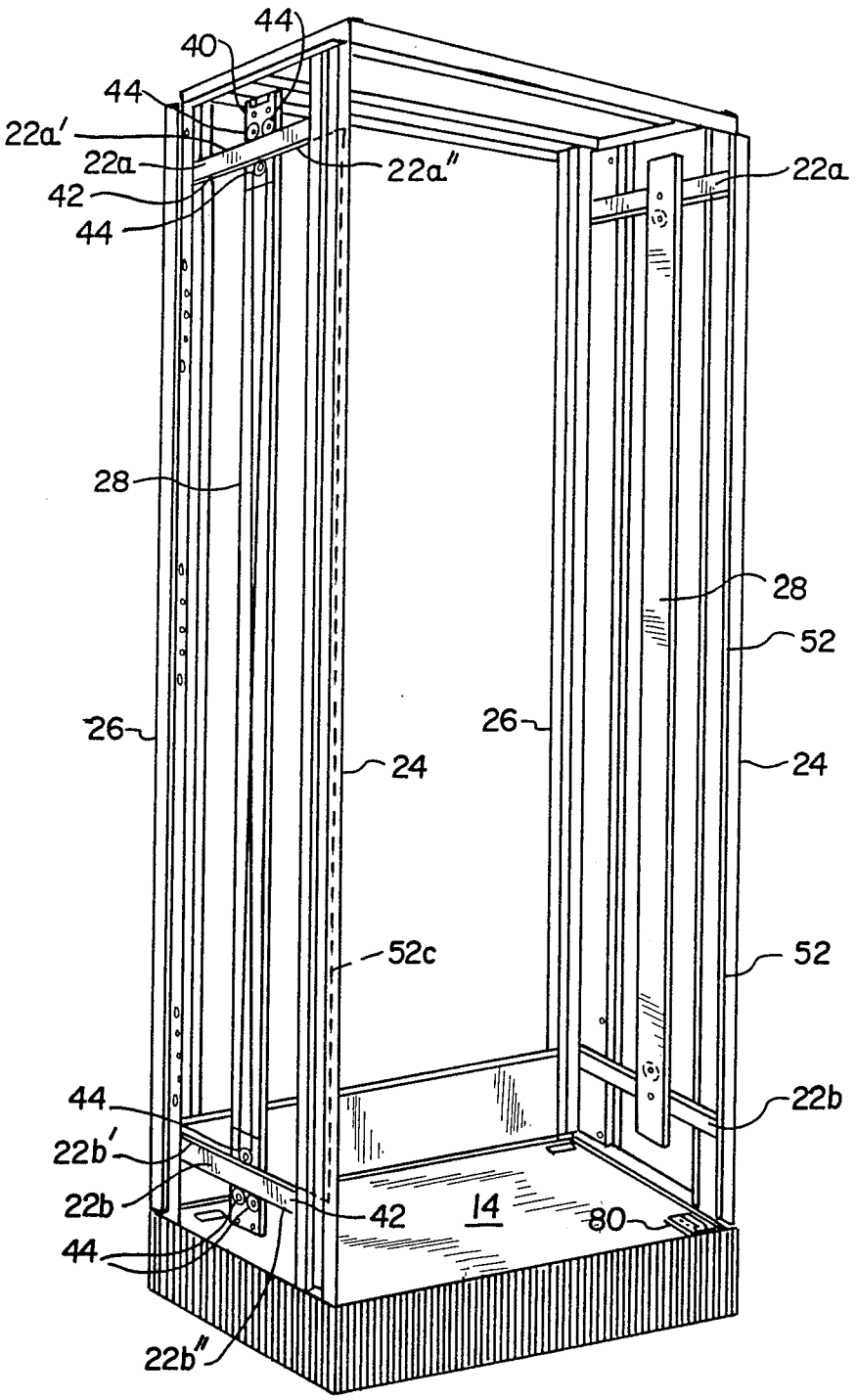
FIG. 10 a perspective view similar to FIG. 4 but looking toward the front vertical frame member and showing a further embodiment for the arrangement of the cable for the pocketing doors and showing further alternative means for slidably mounting the doors to the cabinet.
Figure 11B:
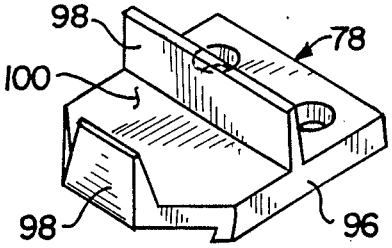
FIG. 11B is a perspective view of an upper guide bracket according to the invention.
Figure 11A:
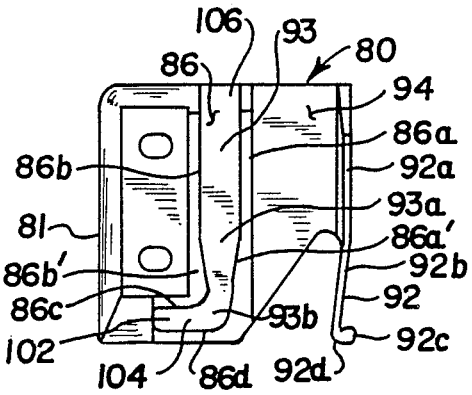
FIG. 11A is a plan view of the lower guide bracket.

An alternative embodiment of the mounting means is shown in FIGS. 9 and 10, wherein the guide frames 22a, 22b may each comprise a flat elongated, rectangular section of metal or plastic 42 which is secured to and between the front and rear vertical frame members 24, 26 at upper and lower ends and inside surfaces thereof. Holes 27a, 27b in the rear vertical frame members function to receive the rear ends of the guide frames 22a, 22b for mounting purposes. Several pulleys 44 are secured to the slide plate 40 and are arranged in a triangular or square pattern. A track associated with each pulley 44 rotatably and engagably receives an opposite longitudinal edge portion 22a', 22a'' and 22b', 22b'', respectively of the guide frames 22a and 22b, for sliding movement of the slide plate 40 and the carrier bar 28 relative to the guide frames 22a, 22b. In the embodiments of FIGS. 9 and 10, the ball cage 36 of FIG. 6 has been eliminated, the sliding movement of the slide plate 40 and the carrier bar 28 being provided by the mounting of the guide frames 22a, 22b between the pulleys 44.

Figure 11:
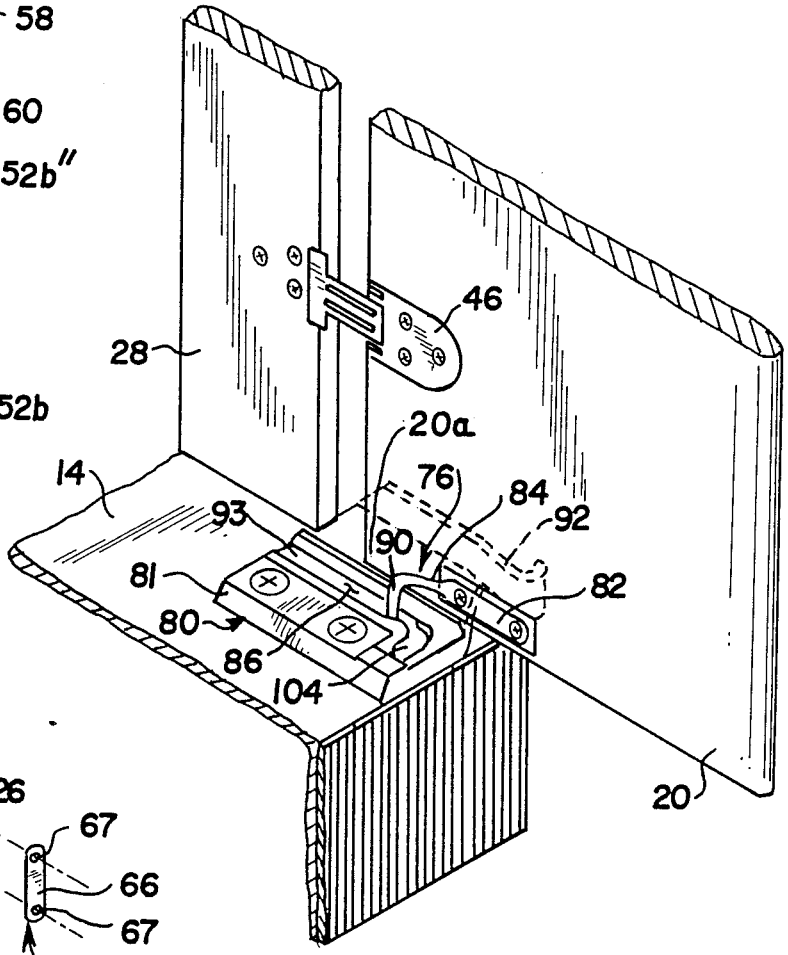
FIG. 11 is a fragmentary perspective of a lower guide bracket, a guide, a pocketing door, and a bottom wall of the cabinet of FIGS. 1–10 according to the invention.

As shown in FIGS. 2 and 11, the mounting means also comprises hinges 46 which mount each door 20 at upper and lower portions thereof to its respective carrier bar 28.

In this manner, each door 20 is movable along with the carrier bar 28 on the guide frames 22a, 22b between the partially pocketed and fully pocketed positions of the door as the carrier 28 is moved between the front and rear ends of the frames.

The stabilizing means is illustrated in FIGS. 4, 5, and 7–10 and functions, as stated above, to resist rotation of the doors in vertical planes to ensure smooth operation of the doors as they are moved between the partially pocketed and fully pocketed positions.

As shown in FIGS. 9 and 9A, a first embodiment of the stabilizing means comprises, on each side of the cabinet, a pair of upper and lower pulleys 48, 50 mounted to outer sides of the carrier bar 28 adjacent the upper and lower ends thereof. The pulleys 48, 50 are positioned on the carrier bar 28 between the upper and lower guide frames 22a, 22b by mounting them to the slide plates 40. Each pulley includes two tracks for receiving a cable 52. First and second ends 52', 52'' of the cable 52 are securely fastened to lower and upper ends, respectively, of the front vertical frame member 24 with cable end clips 54.

Beginning from the lower pulley 50, a first end 52' of the cable 52 is threaded clockwise (as viewed from the interior of the cabinet) around the lower pulley 50, whence it extends upwardly to be threaded counterclockwise around the upper pulley 48. From here it extends rearwardly and through the hole 27a in the rear vertical frame member 26 below the upper guide frame 22a outside of the cabinet. It then extends downwardly along the rear vertical frame member 26 adjacent the back wall 16 until it is level with the lower pulley 50 where it reemerges into the cabinet through the hole 27b located in the rear vertical member 26 above the lower guide frame 22b. The cable 52 then extends forwardly and is threaded counterclockwise around the second track of the lower pulley 50, and thence extends upwardly to be threaded clockwise around the second track of the upper pulley 48. As stated above, the second end 52'' of the cable 52 is attached to the front vertical frame member 24 below the upper guide frame 22a by the cable end clip 54. The tension exerted on the upper and lower portions of the door by the cable 52 tends toward equilibrium, thereby resisting rotational movement of the door in a vertical plane and thus jamming of the door 20 as it is moved between the partially pocketed and fully pocketed positions.

Figure 4A:
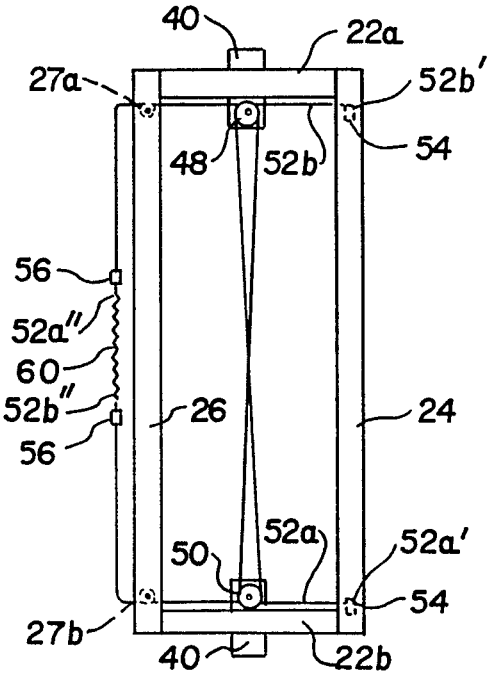
FIG. 4A is a schematic view of the arrangement of the cable of the embodiment of FIG. 4.
Figure 7:
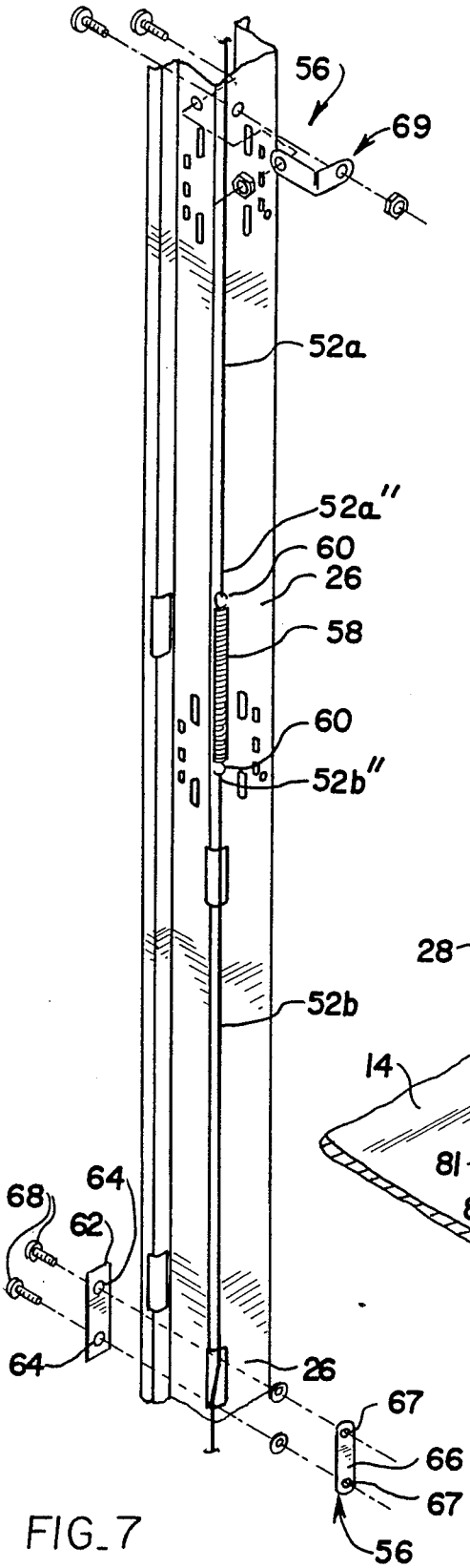
FIG. 7 is an enlarged exploded perspective view of the area of interest designated by the reference numeral B in FIG. 4 and showing an extension spring and two embodiments of a cable tie down assembly according to the invention.

As shown in FIGS. 4, 4A and 7, which illustrate a second embodiment of the stabilizing means, a pair of upper and lower pulleys 48, 50, which are identical to the pulleys 48, 50 of the first embodiment of FIGS. 9 and 9A, are mounted to outer sides of the carrier bar 28 at the upper and lower ends thereof. The pulleys 48, 50 are mounted on the slide plates 40 which, in turn, are mounted on the carrier bar 28, the pulleys being disposed between the upper and lower guide frames 22a, 22b. Each pulley includes two tracks; each track receives one of two cables 52a, 52b.

A first end 52a' of the first cable 52a is securely fastened to a lower end of the front vertical frame member 24 with a cable end clip 54. The first cable 52a is then threaded clockwise (as viewed from the interior of the cabinet) around the lower pulley 50, whence it extends upwardly to be threaded counterclockwise around the upper pulley 48. From here it extends rearwardly along the upper guide frame 22a and through the hole 27a in the rear vertical frame member 26 below the upper guide frame 22a outside of the cabinet. It then extends downwardly along the rear vertical frame member 26 adjacent the back wall to a point approximately midway between the upper and lower guide frames 22a, 22b where the first cable 52a terminates, in a second end 52a'', the second end 52a'' of the first cable 52a'' having an eyeloop as shown clearly in FIG. 7. The first cable 52a is secured, against movement, to the rear vertical frame member by a cable tie down assembly 56 at a point several inches remote from its second end 52a''.

A first end 52b' of a second cable 52b is securely fastened to an upper end of the front vertical frame member 26 with the cable end clip 54. The second cable 52b is then threaded counterclockwise (as viewed from the interior of the cabinet) around the second track of the upper pulley 48, and whence it extends downwardly to be threaded clockwise around the second track of the lower pulley 50. From here it extends rearwardly along the lower guide frame 22b and through the hole 27b in the rear vertical member 26 above the lower guide frame 22b. It then extends upwardly along the rear vertical frame member 26 adjacent to the back wall where it terminates in a second end 52b'' approximately midway between the lower and upper guide frames 22a, 22b. The second end 52b'' of the second cable 52b is provided with an eyeloop. The second cable 52b is secured, against movement, to the rear vertical frame member 26 by a cable tie down assembly 56 several inches remote from the second cable's second end 52b''.

The second ends 52a'', 52b'' of the first and second cables 52a, 52b are connected to opposite ends of an extension spring 58. The forces exerted on the upper and lower portions of the door by the cables tends toward equilibrium, thereby resisting rotational movement of the doors in a vertical plane and thus jamming of the door as it is moved between the pocketed and unpocketed positions.

It can be seen that the second embodiment for arranging the cable differs from the first embodiment by interrupting the continuous run of cable adjacent to the rear vertical frame member 26 with the extension spring 58. Thus, two cables 52a, 52b instead of the single cable 52 are provided. Further, the cables 52a, 52b of the second embodiment are secured to the rear vertical frame member 26 by cable tie down assemblies 56.

The extension spring 58 in conjunction with the tie down assemblies enables the individual assembling the cabinet to properly tension the cables for smooth operation of the doors between the pocketed and unpocketed positions. The cables must be taut to ensure smooth operation of the doors. Similarly, the doors must be oriented such that their upper and lower horizontal edges are parallel with the upper and lower guide frames. Due to the forces exerted on the upper and lower portions of the door by the cables, an individual assembling the cabinet may adjust the vertical orientation of the doors by manipulating the cables and extension spring to exert the appropriate forces. Once the cables and extension spring have been manipulated to properly orient the doors, the cables may be locked or clamped into place by the cable tie down assemblies thus maintaining the appropriate cable tension and door orientation. If, after the initial installation, the doors should for some reason become out of alignment, they may be easily realigned by loosening the cable tie down assemblies and adjusting the tension of the cables to exert the proper forces on the upper and lower portions of the door.

The extension spring 58 is approximately 2¾" in length and is formed of conventional music wire bent into a helical coil terminating at either end in substantially C-shaped hooks 60 for engaging the eyeloops for the second ends 52a'', 52b'' of the first and second cables 52a, 52b.

As shown in FIG. 7, the cable tie down assembly 56 comprises a rectangular plate 62 provided with a pair of spaced apertures 64 at each end, and a complementary shaped double nut 66 having threaded bores 67 aligned with the apertures. The plate 62 and nut 66 are mounted to opposite faces of the rear vertical frame member 26 by screws 68 in registry with the aligned apertures and bores 67. The cable is held in place by clamping it between the plate 62 and the rear vertical frame member 26, the cable diagonally cutting across the face of the plate between the apertures. Alternatively, as is also shown in FIG. 7, the cable tie down assembly 56 may be in the form of an L-shaped clamp 69 mounted on the rear vertical frame member 26 to secure the cable between itself and the rear vertical frame member.

Figure 8:
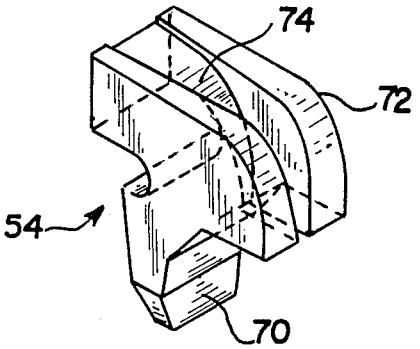
FIG. 8 is an enlarged perspective view of a cable end clip according to the invention.

As shown in FIG. 8, each cable end clip 54 comprises a leg 70 which is received in an aperture in the front vertical frame members 24. Each end clip further comprises a shoulder portion 72 having arcuate track 74 in which the cable is tightly received. First ends 52a', 52b' of the cable may have crimp fittings to further secure the cable to the end clips 54. The crimp fittings bear against the shoulder portion 72 adjacent a narrowed portion of the track 74 to prevent sliding movement of the cables relative the end clips.

A third embodiment for the stabilizing means is shown in FIGS. 10 and 10A and comprises a pair of upper and lower pulleys 48 and 50, which are identical to the pulleys 48 and 50 of the first and second embodiments of the stabilizing means, mounted to outer sides of the carrier bar 28 at the upper and lower ends thereof. The pulleys 48, 50 are mounted on the slide plates 40, which in turn are mounted on the carrier bar 28, the pulleys being disposed between the upper and lower guide frames 22a, 22b. Each pulley includes two tracks for receiving a cable 52c.

A first end 52c' of the cable 52c is formed with an eyeloop which engages a C-hook 60 on one end of an extension spring 58, the spring 58 being identical to the spring 58 of the second embodiment. From the first end 52c' of the cable 52c, the cable extends vertically along the rear vertical frame member where it is routed through a hole 27a in the same and below the upper guide frame 27a. The cable 52c then extends parallel to and below the guide frame 22a to be wound in a clockwise direction (as viewed from inside the cabinet) about the upper pulley 48. The cable then extends downward to be wound in a counterclockwise direction about the lower pulley 50 from whence it extends forwardly along the lower guide frame 22b and through a hole 27c in the front vertical frame member 24. The cable is routed parallel to the front vertical frame member 24, and then backward through a hole 27d in the front vertical frame member below the upper guide frame 22a. The cable extends rearwardly along the upper guide frame 22a to be wound counterclockwise about the upper pulley 48. The cable then descends to be wound clockwise about the lower pulley 50 from whence it extends rearwardly along the lower guide frame 22b and through a hole 27b in the rear vertical frame member 26. The cable then extends vertically along the rear vertical frame member 26, terminating in a second end 52c'' which is formed with an eyeloop. The eyeloop receives a C-hook 60 on the opposite end of the extension spring 58 from which the first end 52c' was received. The cable 52c is secured to the rear vertical frame member 26 at points several inches removed from its first and second ends 52c', 52c'' by cable tie down assemblies 56 which are identical to either of the two embodiments of the cable tie down assembles as shown in conjunction with the second embodiment of the stabilizing means of FIGS. 4, 4A and 7. Thus it can be seen that the third embodiment of the stabilizing means of FIGS. 10 and 10A combines the advantages of the single cable of the first embodiment of FIGS. 9 and 9A with the advantages of the cable tie down assemblies and the extension spring of the second embodiment of FIGS. 4 and 4A. The cable end clips are not an aspect of the third embodiment.

In operation of the stabilizing means, as a door 20 is moved from the partially pocketed to the fully pocketed position, the upper and lower pulleys roll over their respective cables, the cables being fixed and immovable. As the door travels toward the rear ends of the upper and lower guide frames, the cable length between the front vertical frame member and the pulleys "grows" or increases. Correspondingly, the length of cable between the pulleys and the rear vertical frame member "shrinks" or decreases, the amount of cable shrink being equal to the amount of cable growth. Upon moving the door to the partially pocketed position from the fully pocketed position, the reverse of the above occurs.

As stated above, the pocketing assembly further comprises means for partially pocketing the doors 20 relative to the cabinet. To this end, referring to FIGS. 11–12C, the pocketing assembly comprises a guide 76 and upper and lower guide brackets 78, 80. The guide 76 comprises a flat mounting section 82 and an L-shaped guide stud 84 one leg of which is formed integral with the mounting section 82 and offset therefrom at a 45° angle. The mounting section 82 secures the guide 76 to the door 20 at a lower inside edge thereof adjacent to but offset from an outer corner 20*a*, said corner being adjacent to the cabinet side wall 18 when the door 20 is closed. The guide 76 is formed from hardened carbon steel wire in a two step die process. In the first step, the wire is bent to form the L-shape guide stud 84. In the second step, a portion of the steel wire is flattened and punched to provide the mounting section 82.

The lower guide bracket 80 comprises a molded plastic member having an L-shaped track 86 formed therein. The track 86 has a long leg 93 and a short leg 104 which are defined by track walls 86*a*, 86*b*, 86*c*, 86*d* molded integral with the lower guide bracket 80. The short leg 104 of the track 86 is of uniform width but generally narrower than the width of the long leg 93. The long leg 93 is similarly of uniform width except in a transition region 93*a* where the width of the track narrows to approximate that of the short leg 104. In the transition region 93*a*, the track walls 86*a* and 86*b* are provided with complementary, inwardly directed beveled surfaces 86*a*′ and 86*b*′. The lower guide bracket 80 is secured by conventional mounting hardware to the front edge of the bottom wall 14 of the cabinet adjacent a front corner formed by the bottom wall 14 and the side wall 18. When properly positioned, a distal end 90 of the guide stud 84 is received by the L-shaped track 86 of the lower guide bracket 80.

The lower guide bracket 80 further includes a spring arm 92 formed integral therewith and substantially parallel to the track wall 86*a*, thus defining a channel 94 between the spring arm 92 and the track wall 86*a*. The spring arm 92 is formed with a relatively stiff portion 92*a* that is integral with a base 81 of the lower guide bracket 80 and a resilient portion 92*b* that is continuous with the relatively stiff portion 92*a*. The resilient portion 92*b* is angled inwardly slightly toward the track wall 86*a*. A distal end of the resilient portion 92*b* is formed with a contoured lobe 92*c* that provides a camming surface 92*d*. The width of the channel 94 between the stiff portion 92*a* of the spring arm 92 and the track wall 86*a* is slightly greater than the thickness of the pocketing door 20. The width of the channel 94 between the resilient portion 92*b* of the spring arm and the track wall 86*a* is slightly less than the thickness of the pocketing door 20.

A second embodiment of the lower guide bracket 80 is shown in FIGS. llC and 12C. The second embodiment is substantially similar to the first embodiment differing only in its provision of a chamfered corner 86*e* intermediate the track walls 86*b* and 86*c*.

The upper guide bracket 78 is a molded plastic component having a flat base 96 and a pair of parallel, spaced apart depending flanges 98 which provide a channel 100 therebetween. The upper guide bracket 78 is mounted to the underside of the cabinet top wall 12 or an analogous element of the cabinet frame adjacent a forward corner 12*a* formed generally by the cabinet topwall 12 and side wall 18, as shown in FIG. 2. The upperguide bracket 78 is mounted to the cabinet using conventional hardware.

Figure 12:
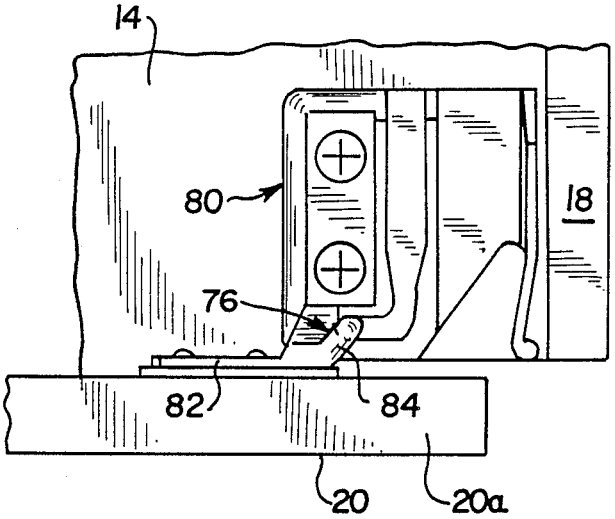
FIG. 12 is a fragmentary plan view showing the pocketing door and the lower guide bracket according to the invention of FIGS. 1–11B, with the pocketing door in a fully closed position.
Figure 12A:
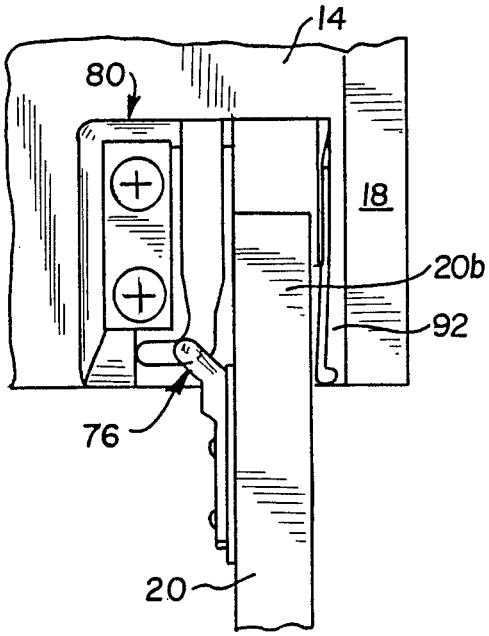
FIG. 12A is a fragmentary plan view showing the pocketing door and the lower guide bracket according to the invention of FIGS. 1–12, with the pocketing door in the open and partially pocketed position.

When the door is in the closed position, as shown in FIG. 12, the guide stud 84 is located at a distal end 102 of the short leg 104 of the L-shaped track 86. As each door 20 is swung to the open and partially pocketed position, the door is forced approximately 2″–3″ into the cabinet to partially pocket the door. See FIG. 12A.

More specifically, as each door is moved from the closed to the open and partially pocketed position, the 35 door horizontally rotates 90° about an axis or pivot point of the distal end 90 of the guide stud 84. Simultaneously, the guide stud 84 and the door 20 slide laterally within the short leg 102 of the L-shaped track 86 in a direction away from the distal end 104 of the short leg 102 and toward the cabinet side wall 18. At the conclusion of the open swing, the guide stud 84 is located approximately at a proximal end 93*b* of the short leg 104 of the L-shaped track 86. Thus, a dynamic pivot point of the door relative to the cabinet, the position of which is continuously changing as the door is opened, is provided.

As the door is simultaneously sliding and rotating, a portion 20*b* of the door 20, which portion extends between the outside corner 20*a* to that area of the door to which the flat mounting portion 82 of the guide 76 is secured, is captured within the channels 94 and 100 of the lower and upper guide brackets 80, 78. As the door swings through 90° from the closed to the open and partially pocketed position, the outside corner 20*a* of the door bears against the camming surface 92*d* of the spring arm 92. The resilient portion 92*b* of the spring arm 92 is displaced sufficiently to allow the door 20 to enter the channel 94 of the lower guide bracket 80. The natural tension of the resilient portion 92*b* of the spring arm 92 maintains the spring arm 92 against the door 20 to prevent lateral or rattling motion of the door when the door is subsequently moved between the partially and fully pocketed positions. Thus a smoothly operating, easily functioning pocketing door is provided.

Figure 12B:
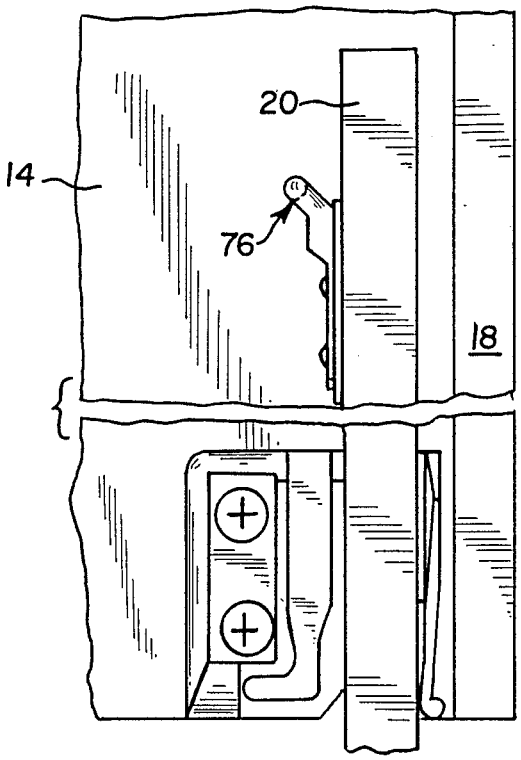
FIG. 12B is a fragmentary plan view showing the pocketing door and the lower guide bracket according to the invention of FIGS. 1–12A, with the pocketing door in the open and fully pocketed position.

In the open and partially pocketed position, the door is captured within the channels 94 and 100 of the lower and upper guide brackets 80, 78. Further, the door is aligned with the vertical carrier bar 28 and the adjacent cabinet side wall 18 and is positioned to be moved between the partially and fully pocketed positions. A user may move the door from the partially pocketed position to the fully pocketed position by the application of a rearwardly directed force to the door, which causes the door and the carrier bar to which it is mounted, to slidably move along the upper and lower guide frames 22a, 22b toward the rear ends of the same, thus fully pocketing the door. As the door is moved to the fully pocketed position, as shown in FIG. 12B, the guide stud 84 exits the distal end 106 of the long leg 93 of the L-shaped track 86 which is open. The reverse of the above described sequence occurs when a door is moved from the fully pocketed position to the open and partially pocketed position, and then moved to the closed position.

The operation of the door can be more easily understood when it is realized that in order to partially pocket a door on the open swing, the guide stud, or pivot point for the door relative to the cabinet must be offset from the edge of the door. However, such an arrangement will cause the door, after being opened, to be partially pocketed at a distance quite removed from the cabinet side wall. Obviously, this is undesirable as it creates a void of generally unusable space between the door and the adjacent cabinet side wall. To maximize the volume of usable space within the cabinet interior, it is desirable to have the door partially pocketed closely adjacent to the cabinet side wall. Thus, in order for the door to be pocketed in a position different from that provided by the pivot point offset from the door edge, a dynamic pivot that simultaneously allows the door to rotate and laterally slide from its initial position to its subsequent and desired position closely adjacent to the cabinet side wall must be provided. Further, if the door is to be fully pocketed it must be hingeably connected at its edge, or at a point closer to the edge of the door than the pivot point, to a vertical carrier bar that is mounted for sliding movement relative to the cabinet.

The guide 76, offset from the corner of the door 20a, in combination with the short leg 104 of the L-shaped track 86 in the lower guide bracket 80 provide means for partially pocketing the door 20 when it is moved through a 90° arc from the closed position. Thus the door and its hinges are protected from damage. If, while in the open position but before the doors have been fully pocketed, the doors should be accidentally impacted, for example, by a person stumbling against them, a portion of the door including the edge to which the hinges are mounted as well as the hinges themselves are already positioned within the cabinet. Thus, the impact is absorbed by the door and the cabinet frame rather than the hinges, which could yield and fracture under the force.

The channel 100 of the upper guide bracket 78 in combination with the channel 94 and the spring arm 92 of the lower guide bracket 80 provide means for aligning the pocket door 20 parallel to the cabinet side wall 18 in preparation for subsequent pocketing. Similarly, the alignment means maintains each door in a parallel relation to the cabinet side wall as the door is moved to a fully pocketed position. A portion of the door is always captured within the channels 94, 100 of the upper and lower guide brackets 78, 80, thus facilitating easy operation of the doors. Further, the transition region 93a functions to properly align the door for movement into the short leg 104 of the track 86 when the door 20 is moved to the closed position from the partially pocketed position. The transition region 93a channels the door 20 into the short leg 104.

Figure 11C:
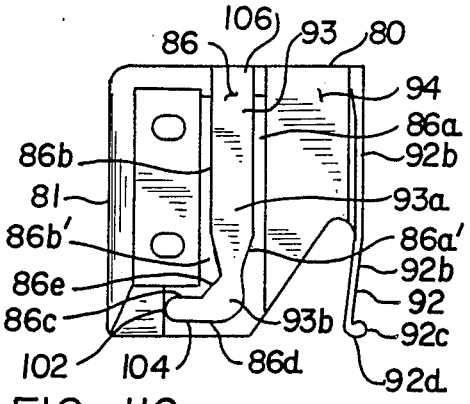
FIG. 11C is a plan view of a second embodiment of the lower guide bracket.
Figure 12C:
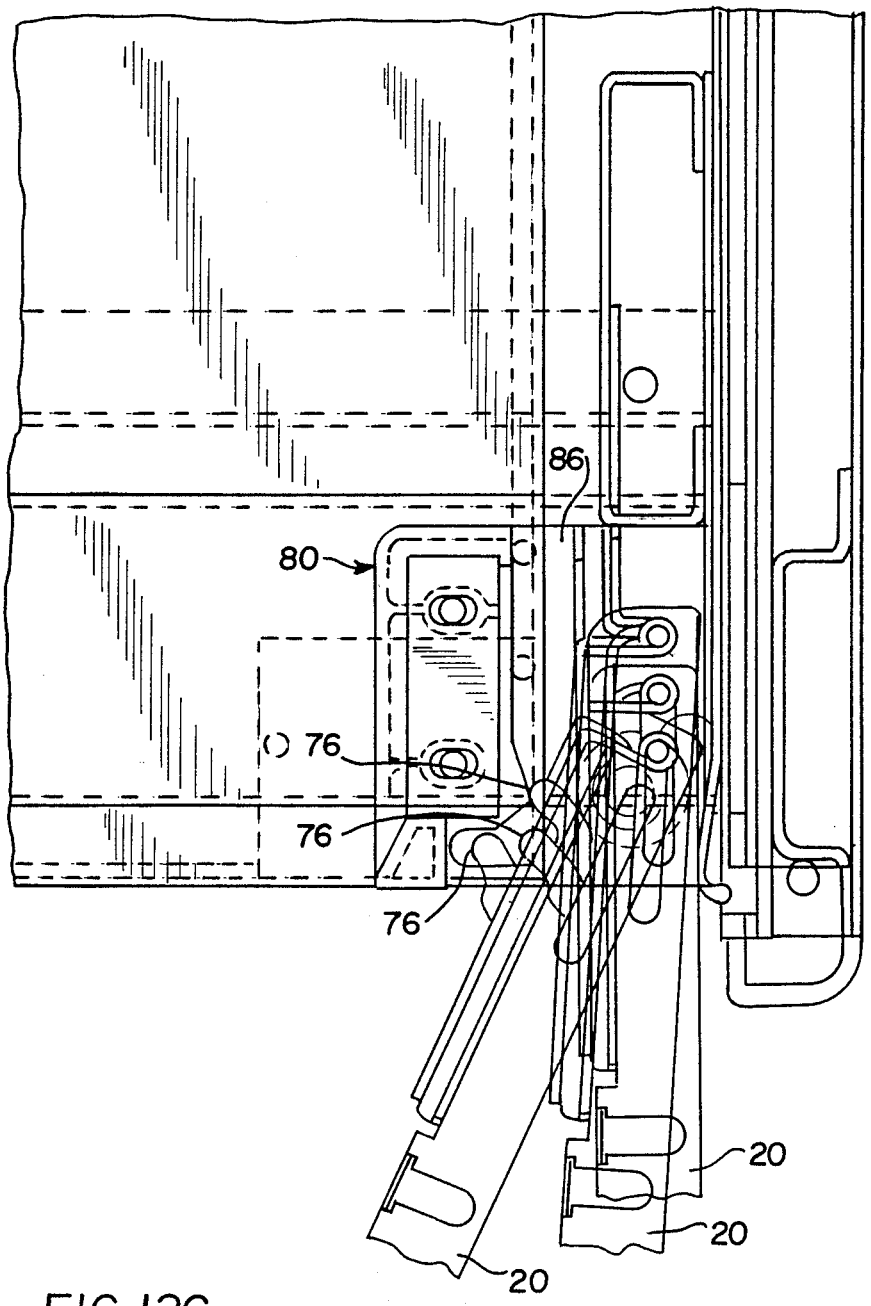
FIG. 12C is a plan view showing schematically the second embodiment of the lower guide bracket of FIG. 11C and the layout of the door in a plurality of positions as the door is moved between the open and partially pocketed position and the open and fully pocketed position.

Similarly, the chamfered corner 86e in the second embodiment of the lower guide bracket 80 shown in FIGS. 11C and 12C facilitates the movement of the guide 76 between the short leg 104 and the long leg 93 of the L-shaped track by providing a beveled surface along which the guide stud 84 may slide.

The alignment means further performs a protective function. As each door is moved from the closed to the 35 open and partially pocketed position, the track wall 86a provides an internal stop against further lateral movement of the door 20. The track wall 86a restrains the movement of the guide 76 such that it moves only within the track 94. Thus, the door can not be slid laterally beyond the travel allowed by the track 86. Limiting the lateral movement of the door protects the door and the hinges from the damage that could result if one attempted to force the doors closer to the cabinet side wall 18.

Further, the wall 86a of the lower guide bracket 80 provides means for indicating the position of the door 20. The internal stop provided by the wall 86a and described above also indicates that the door has reached the extent of the open swing and is properly positioned for rearward sliding movement into the cabinet to fully pocket the door. That is, the contact of the guide stud 84 with the track wall 86a provides a noticeable indication to a user that the door should not be further slid laterally and that the user should apply a rearwardly directed force to fully pocket the door. Similarly, as each door is moved from the fully pocketed position to the open and partially pocketed position, the guide stud 84 enters the transition region 93a of the track 86. The transition region 93a smoothly channels the guide stud 84 into the short leg 104 of the track 86 for subsequent closing movement. Also, the transition region 93a functions to slightly but noticeably retard the movement of the door, a change which is detectable by the user and which indicates that the door is properly positioned for movement to the fully closed position.

To facilitate manual operation of the doors between the closed, open and partially pocketed, and the open and fully pocketed positions, the same are provided with handles 108 rotatably mounted to the doors 20 in such manner that the handle orientation can be maintained in a direction toward the worker operating the doors.

Figure 13:
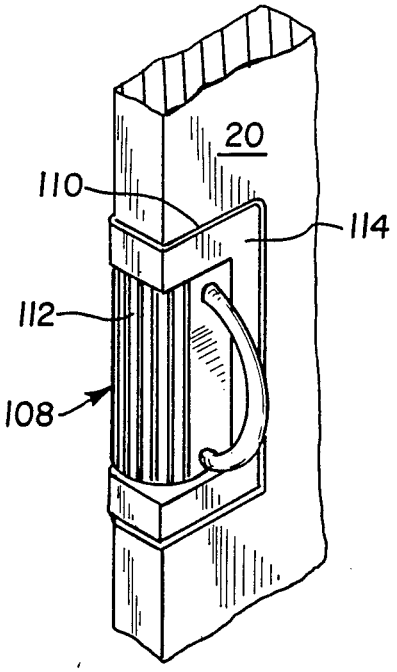
FIG. 13 is an enlarged perspective view of a door handle according to the invention.

Referring to FIGS. 1 and 13, on each side of the cabinet, the handle 108 is rotatably mounted to an inner edge of the door 20 by way of a cutout 110 in the door. Each door handle comprises a door pull 112 and a bezel 114 which is secured to the door in registry with the cutout.

Figure 15:
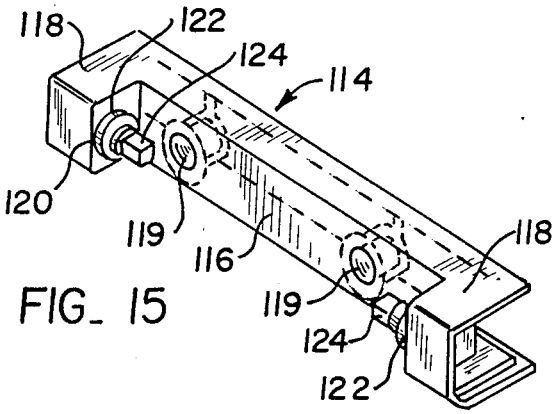
FIG. 15 is a perspective view of a bezel of the handle of FIGS. 13–14 according to the invention.

As illustrated in FIG. 15, the bezel 114 is a substantially square U-shaped molded plastic member having a web 116 intermediate to and integral with a pair of parallel spaced apart legs 118. The bezel 114 is placed in registry with the door cut-out 110 and secured to the door with a pair of screws (not shown) which are received by apertures 119 formed in the bezel's web. A pair of pins 120, formed integral with inside faces of the legs 118, extend parallel to the web 116 and are disposed in facing relationship. Each pin 120 comprises a circular base 122. Extending outwardly from each base is an elongated square projection 124.

Figure 16:
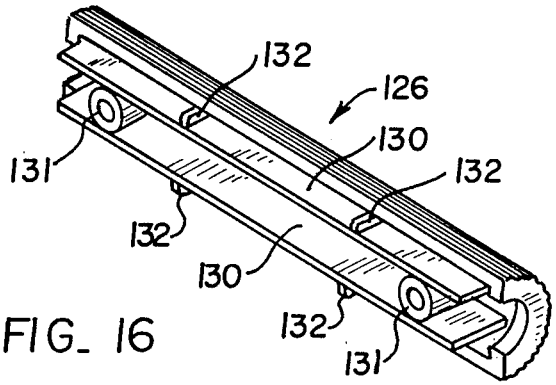
FIG. 16 a perspective view of a front half of the door pull of the handle of FIGS. 13–15 according to the invention.

The door pull 112 comprises complementary shaped front and back hollow halves 126 and 128, and a pair of leaf springs 130. As illustrated in FIG. 16, the front half 126 of the door pull 112 is an elongated injection molded plastic component open at each end and having a semi-circular shape in cross-section. A pair of inwardly directed parallel hollow cylindrical posts 131 are formed on an inside surface of the door pull's front half. Also projecting from the inside surface of the front half of the door pull intermediate the posts are two pairs of oppositely disposed flanges 132.

Figure 14:
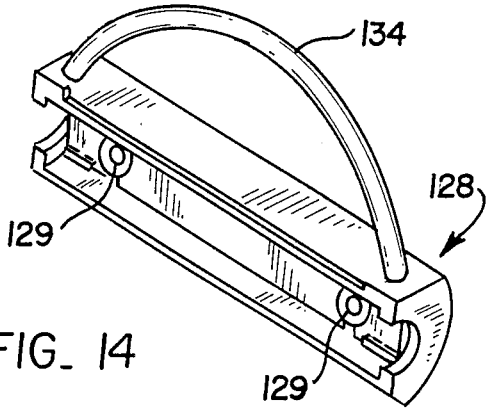
FIG. 14 is a perspective view of a back half of a door pull of the handle of FIG. 13 according to the invention.

As shown in FIG. 14, the back half 128 of the door pull 112 is an elongated injection molded plastic component open at each end. The back half of the door pull has a substantially semi-circular shape in cross-section and is provided with a pair of apertures 129 formed along approximately the axial center line of the door pull half. Opposite ends of a bail handle 134 are mounted to the back half 128 of the door pull 112 on a longitudinal side of the back half.

Each leaf spring 130 comprises an elongated rectangular section of resilient metal.

In assembly, the two leaf springs 130 are mounted on the door pull's front half 126 in a parallel spaced relation by positioning the springs on opposite sides of the cylindrical posts 131 such that a longitudinal edge of each leaf spring is parallel to the front half's longitudinal edges. Each leaf spring 130 bears against one of the two pair of oppositely disposed flanges 132. In this manner, the springs 130 are held between the respective flanges 132 and posts in parallel spaced apart relationship, such spacing being slightly greater than the cross-sectional geometric dimension of the square portions 124 of the pins.

The front door pull half 126 is mounted to the bezel 114. The semi-circular openings at each end receive the circular portion 122 of the bezel pins 120 and complementary ends of the leaf springs receive and engage opposite faces of the square portions 124 of the bezel pins.

The back half 128 of the door pull is mounted to the bezel pins 120 such that the open semi-circular ends receive the circular portion 122 of the pins. The back half of the pull is secured to the front half of the pull by screws that register with the apertures 129 in the back half of the door pull and the hollow cylindrical posts 131 in the front half of the door pull.

The engagement of the tensioned leaf springs 130 with the square portions 124 of the bezel pins 120 provides detent means for rotating the door pull relative to the bezel 114 to achieve any one of a number of adjusted positions. In operation, as a user grasps the bail 134 and pulls, the door pull 112 rotates about the bezel pins 120 until the center line of the bail is aligned with the direction of the applied force. The ends of the leaf springs rotate about the square portions 124 of the bezel pins 120 to move to positions of engagement with opposite corners of the square portions 124. From this orientation, a relatively small force is required to continue the rotation of the spring ends until they engage the adjacent faces of the bezel pins' square portions. Thus the door handles are rotatable through 180° with detent stop positions at the 0°, 90°, and 180° relative orientations.

Figure 17:
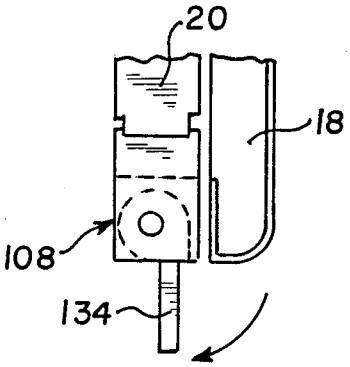
FIG. 17 is a fragmentary plan view showing schematically the operation of the handle of FIGS. 13–16 according to the invention, with a bail of the handle coplanar with the pocketing door.
Figure 18:
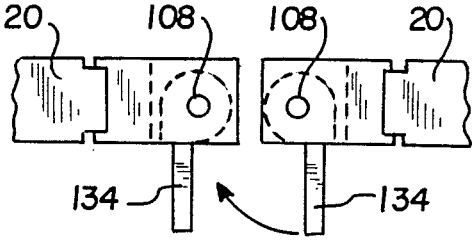
FIG. 18 is a fragmentary plan view showing schematically the operation of the door handle of FIGS. 13–17 according to the invention, with the bail of the handle normal to the pocketing doors.

As illustrated in FIGS. 13, 17 and 18, when the doors are in the closed position, the handle is positioned so that the bail 134 is normal to the plane of the door 20. As the door is moved to the open position, the handle is rotated so that the bail 134 is positioned coplanar with the door. The door can then be fully pocketed into the cabinet as well as easily withdrawn from the same. In this manner, a worker can grasp the bail of the handle to open the door and pocket the same while maintaining the orientation of the bail toward himself/herself for convenient operation of the door.

It will be appreciated that the instant specification and claims are set forth by way of illustration and not limitation, and that various modifications and changes may be made without departing from the spirit and scope of the invention.

We claim:

1. In a cabinet comprising, a pair of side walls, a top wall, a back wall, and a bottom wall connected together to provide a cabinet framework having an open front and an open interior;

a door having a first edge and a second edge opposite the first edge;

means for pivotally mounting the door to the cabinet framework for movement between a closed position wherein the door is adapted to at least partially cover the open front and to at least partially enclose the open interior, and a pocketed position wherein the door is received within the open interior of the framework and adjacent to one of the side walls, the first edge of the door being first received within the framework during the movement of the door to the pocketed position;

characterized in that the door mounting means guides the door toward a partially pocketed position wherein the first edge of the door is guided into the framework interior as the door pivots from the closed position to the partially pocketed position.

2. A cabinet according to claim 1, wherein the door mounting means further includes a pivot support to support the door for pivotable movement thereon and the pivot support simultaneously translates toward said one side wall as said door pivots from the closed position to the partially pocketed position.

3. A cabinet according to claim 2, wherein the closed and partially pocketed positions of the door are at a substantially right angle to each other.

4. A cabinet according to claim 3, wherein the partially pocketed and pocketed positions of the door are substantially coplanar with each other.

5. A cabinet according to claim 4, wherein the pivot support includes a guide stud extending from the door and the door mounting means further comprises a bracket and means for mounting the bracket to the framework, the bracket further including a portion defining a track formed therein, the guide stud being received within the track, whereby the track guides the stud and the first edge of the door into the framework interior as the door pivots from the closed position, the guide stud defines the axis about which the door rotates, and the guide stud translates along the track toward said one of the side walls as the door pivots.

6. A cabinet according to claim 5, wherein the door further includes an upper edge and a lower edge and the guide stud extends from the lower edge and generally perpendicular to the bottom wall and further wherein the bracket is mounted to the bottom wall.

7. A cabinet according to claim 6, wherein the track has a substantially L-shaped configuration comprising first and second legs that are oriented substantially perpendicular one to the other and the second leg is substantially parallel to said one of the side walls.

8. A cabinet according to claim 7, wherein the first leg is closed at one end thereof and is continuous with the second leg at the other end thereof and wherein the opposite end of the second leg is generally open, and further wherein the closed end of the first leg retains the guide stud within the track when the door is in the closed position, the stud translates along the first leg toward the second leg as the door pivots from the closed position and is received approximately within the juncture of the first and second legs when the door is in the partially pocketed position, and the stud translates along the second leg and exits from the open end thereof as the door moves toward the pocketed position.

9. A cabinet according to claim 7, wherein the guide bracket further includes a base and an arm mounted to the base, the arm being substantially parallel to the second leg and spaced therefrom so as to define a channel therebetween, wherein the arm guides the first edge of the door into the channel as the door pivots from the closed position.

10. A cabinet according to claim 9, wherein the door has a given thickness and the channel includes a portion having a width less than the thickness of the door, and further wherein the arm is resiliently mounted to the base and includes a camming surface at one end thereof, wherein the door engages the camming surface as it pivots from the closed position and displaces the arm in a direction away from the second leg as the first edge of the door is received within the channel, and further wherein the arm engages the door to restrain the door against undesired lateral movement as the door is moved toward the pocketed position.

11. A cabinet according to claim 5, wherein the door includes a third edge and a fourth edge opposite the third edge, the third and fourth edges being substantially perpendicular to the first and second edges, the guide stud extends from the third edge, and further wherein the door mounting means comprises a second bracket and means for mounting the second bracket to the framework opposite the first bracket, wherein the second bracket includes a portion defining a channel, the channel being adapted to receive the fourth edge and to guide the door toward the pocketed position.

12. A cabinet according to claim 11, wherein the second bracket includes a base for mounting the bracket to the framework and a pair of spaced apart parallel legs depending from the base and defining the channel therebetween.

13. A cabinet according to claim 12, wherein the third edge is a lower edge of the door, the fourth edge is an upper edge of the door, the first bracket is mounted to the bottom wall of the framework, and the second bracket is mounted to the top wall of the framework.

14. A cabinet according to claim 1 and further comprising stabilizing means to prevent relative rotation of the door with respect to the framework as the door moves from the closed position to the pocketing position.

15. A cabinet according to claim 14 wherein the mounting means further comprises a carrier bar, means for mounting the carrier bar to the framework for translational movement with respect thereto parallel to the one side wall, and means for pivotally mounting the door at the first edge thereof to the carrier bar, and wherein the stabilizing means comprises at least two pulleys mounted to the carrier bar and a cable wound around the pulleys and fixed to the framework.

16. A cabinet according to claim 1 and further comprising a handle rotatably mounted to the door for movement between an orientation perpendicular to the face of the door for gripping when the door is in the closed position and an orientation parallel to the face of the door and projecting from the second edge of the door when the door is in the pocketed position.

17. A cabinet comprising, a pair of side walls, a top wall, a back wall, and a bottom wall connected together to provide a cabinet framework having an open front and an open interior;

a door having a first edge and a second edge opposite the first edge;

means for pivotally mounting the door to the cabinet framework for movement between a closed position wherein the door is adapted to at least partially cover the open front and to at least partially enclose the open interior, and a pocketed position wherein the door is received with the open interior of the framework and adjacent to one of the side walls, the first edge of the door being received within the framework during the movement of the door to the pocketed position; and stabilizing means to prevent relative rotation of the door with respect to the framework as the door moves from the closed position to the pocketed position;

wherein the door mounting means comprises a carrier bar, means for mounting the carrier bar to the framework for translational movement with respect thereto parallel to the one side wall, and means for pivotally mounting the door at the first edge thereof to the carrier bar; and wherein the stabilizing means comprises at least two pulleys mounted to the carrier bar and a cable wound around the pulleys and fixed to the framework.

18. A cabinet according to claim 17, wherein each pulley includes a pair of tracks and the cable is wound around each pulley twice, the cable being received in each track of each pulley.

19. A cabinet according to claim 18, wherein the cable is under tension and the stabilizing means further includes a spring for tensioning the cable.

20. A cabinet according to claim 19, wherein the stabilizing means further includes a cable tie down assembly for selectively and releasably retaining the cable at a desired tension.

21. A cabinet according to claim 20, wherein the cable tie down assembly includes means for clamping the cable to the framework.

22. A cabinet according to claim 21, wherein the cable is secured to the framework adjacent to the spring.

23. A cabinet according to claim 17, wherein the cable is under tension, the stabilizing means further includes a spring, and the cable comprises first and second cable portions, each cable portion having a first end and a second end, and further wherein the first end of each cable is fixed to the framework and the second end of each cable is secured to the spring, thereby tensioning the cable.

24. A cabinet according to claim 23, wherein each pulley includes a pair of tracks and the cable is wound around each pulley, the cable being received in at least one track of each pulley.

25. A cabinet according to claim 24, wherein the stabilizing means includes a cable tie down assembly for selectively and releasably retaining the cable at a desired tension.

26. A cabinet according to claim 25, wherein the cable tie down assembly includes means for clamping the cable to the framework.

27. A cabinet according to claim 26, wherein the cable is secured to the framework adjacent to the spring.

28. A cabinet according to claim 17 and further comprising a handle rotatably mounted to the door for movement between an orientation perpendicular to the face of the door for gripping when the door is in the closed position and an orientation parallel to the face of the door and projecting from the second edge of the door when the door is in the pocketed position.

29. In a cabinet comprising, a pair of side walls, a top wall, a back wall, and a bottom wall connected together to provide a cabinet framework having an open front and an open interior;

a door having a first edge and a second edge opposite the first edge;

means for pivotally mounting the door to the cabinet framework for movement between a closed position wherein the door is adapted to at least partially cover the open front and to at least partially enclose the open interior, and a pocketed position wherein the door is received within the open interior of the framework and adjacent to one of the side walls, the first edge of the door being received within the framework during the movement of the door to the pocketed position;

characterized by a handle rotatably mounted to the door for movement between an orientation perpendicular to the face of the door for gripping when the door is in the closed position and an orientation parallel to the face of the door and projecting from the second edge of the door when the door is in the pocketed position.

30. A cabinet according to claim 29, wherein the second edge of the door includes a recess, the handle being received within the recess.

31. A cabinet according to claim 29, wherein as the door is moved between the closed and pocketed positions the handle rotates to an orientation that is aligned with the direction in which the force to move the door is applied.

32. A cabinet according to claim 31, wherein the handle includes a spring for selectively retaining the handle in the desired orientation.

33. A cabinet according to claim 32, wherein the handle further includes a pair of pins, each pin having an equal number of faces, and the spring engages a first face of each pin when the handle is in a first orientation.

34. A cabinet according to claim 35, wherein the spring rotates as the handle is rotated to a second orientation displaced from the first orientation, whereby the spring engages a second face of each pin when the handle is in the second orientation.

35. A cabinet according to claim 34, wherein each pin has four faces.

36. A cabinet according to claim 35, wherein each pin is substantially square in cross section, the handle includes a pair of springs, and each spring engages one of the pin faces, the faces engaged by each pin being opposed.

* * * * *